US006398191B1

(12) United States Patent
Forsberg

(10) Patent No.: US 6,398,191 B1
(45) Date of Patent: Jun. 4, 2002

(54) DEVICE FOR AN ELECTRICAL FENCE

(75) Inventor: Gunnar Forsberg, Stockholm (SE)

(73) Assignee: Fogim HB (SE)

( * ) Notice: Subject to any disclaimer, the term of this patent is extended or adjusted under 35 U.S.C. 154(b) by 0 days.

(21) Appl. No.: 09/762,411

(22) PCT Filed: Jul. 26, 1999

(86) PCT No.: PCT/SE99/01317

§ 371 (c)(1),
(2), (4) Date: Feb. 7, 2001

(87) PCT Pub. No.: WO00/11918

PCT Pub. Date: Mar. 2, 2000

(30) Foreign Application Priority Data

Aug. 7, 1998 (SE) ..... 9802688

(51) Int. Cl.[7] ..... H05C 3/10
(52) U.S. Cl. ..... 256/10
(58) Field of Search ..... 256/10

(56) References Cited

U.S. PATENT DOCUMENTS

| | | | | |
|---|---|---|---|---|
| 3,655,995 A | | 4/1972 | Malme | |
| 5,771,147 A | * | 6/1998 | Eriksson et al. | 361/232 |
| 5,877,949 A | * | 3/1999 | Wolfgram et al. | 261/232 X |

FOREIGN PATENT DOCUMENTS

| | | |
|---|---|---|
| EP | 0 177 899 | 4/1986 |
| FR | 2 604 324 | 9/1986 |
| FR | 2 628 591 A1 | 3/1988 |
| FR | 2 673 020 A1 | 2/1991 |
| FR | 2 725 870 A1 | 10/1994 |

* cited by examiner

*Primary Examiner*—Lynne H. Browne
*Assistant Examiner*—John R. Cottingham
(74) *Attorney, Agent, or Firm*—Michaelson & Wallace; Peter L. Michaelson

(57) ABSTRACT

The invention refers to a device for an electric fence. The device include an electric unit (1) which is connectable to an electrically conducting fence (2) and which includes a voltage generator (4) arranged to apply a relatively high electric voltage to said fence (2). Furthermore, the device include a proximity detector (5), which is arranged to sense a state at which an animal is at least in contact with or in the proximity of said fence (2), and a control unit (6), which is connected to the voltage generator (4) and the proximity detector (5) and arranged to activate the voltage generator (4) to apply the relatively high electric voltage to the fence (2) in response to the state. The proximity detector (5) is arranged to detect the state by sensing an electric parameter, which substantially depends on the capacitance between the fence (2) and ground.

9 Claims, 3 Drawing Sheets

DEVICE FOR AN ELECTRICAL FENCE

The present invention refers to a device for an electric fence, including an electric unit, which is connectable to an electrically conducting fence and includes a voltage generator arranged to apply a relatively high electric voltage to said fence, a proximity detector, which is arranged to sense a state at which an animal is in contact with or in the proximity of said fence, and a control unit, which is connected to the voltage generator and the proximity detector and arranged to activate the voltage generator to apply said relatively high electric voltage to said fence in response to said state.

The invention is primarily directed to electric fences for protecting plant arrangements and plantations, such as kitchen gardens, flower bed, single plants, and smaller gardens, from being entered and destroyed by animals, for instance roe deer, hares, rabbits, etc. Although the device to be described primarily is adapted to smaller plant arrangement, it is to be noted that the solution according to the invention also is applicable to electric fences for defining the space of movement for cattle, such as for instance sheep, cows, horses, etc. Also other areas of application than electric fences are possible for the device according to the invention.

Electric fences are well known for preventing animals from entering or leaving in an area. Conventional electric fences operate in such a manner that they at uniform time intervals, for instance once per second, applies a high voltage pulse to the electric fence. Normally a transformer is utilised, the primary winding of which is connected to a batter of any other voltage source via a switch. The switch is closed during for instance on second and is thereafter opened, wherein a high voltage pulse is formed at the secondary winding of the transformer which is connected to the electric fence and to ground via a so-called earth spit.

The disadvantage of such conventional electric fences are the high consumption of effect since the high voltage pulses are generated continuously irrespective of if an animal touches the fence or not. This means that a batter which is utilised for powering the electric fence frequently has to be charged, which is a time and labour consuming operation. In order to overcome this problem it has been proposed to use proximity detectors in order to enable application of a high voltage only when an animal is in contact wit the electric fence. Such proximity detectors are known from the patent literature. For instance, FR 2 604 324EP 177 899 and U.S. Pat No. 3.655,995 disclose electric fences with proximity detectors. These known proximity detectors are based on the principal that a relatively low direct voltage is applied to the electric fence and that the resistance between the electric fence and ground is sensed. When the electric fence is free from contact to the ground, the resistance is thus very high and when an animal touches the electric fence the resistance sensed decreases, which may be detected by means of the proximity detector. When a reduced resistance has been detected a high voltage, which is applied to the electric fence, is generated.

However, such proximity detectors have a relatively low sensitivity since the resistance still may be relatively high when an animal for instance only touches easily the electric fence and/or when the ground and the animal in question are relatively dry. Furthermore, humid grass or other humid plants, which touch the electric fence, may reduce the resistance so much that high voltage will be generated. A further problem with this type of proximity detectors is that oxide formation on the electric fence leads to an increase of the resistance.

FR p2 725 870 discloses another type of electric fence having a condenser which is charged with a high voltage and when an animal touches the electric fence the condenser is discharged.

Consequently, this document discloses no proximity detector in a proper sense.

FR 2 673 020 discloses an electric fence having an electric conduit which forms a closed loop between two terminals of a unit which is arranged to generate high voltage pulses. The device disclosed includes a detecting unit which is arranged to detect the presence of an intruder by sensing a variation in the capacitance.

SUMMARY OF THE INVENTION

The object of the present invention is to provide an electric fence having a high detecting reliability and a low energy consumption.

This object is obtained by the device initially defined, which is characterized in that the proximity detector is arranged to detect said state by sensing an electric parameter, which substantially depends on the capacitance between said fence and ground. In such a manner it is possible to apply high voltage pulses only when the presence of an animal is detected. By sensing the capacitance which exists between the electric fence and ground, instead of the resistance sensed according to the prior art, a higher sensitivity is obtained. Consequently, the invention relies on the understanding that the capacitance between the electric fence and ground is changed if an animal touches the electric fence and that such a change is detectable by means of different electric circuit solutions.

According to an embodiment of the present invention, a control unit is arranged to initiate said sensing discontinuously during relatively short recurrent time periods. In such a manner the energy consumption may be reduced significantly by the fact that the proximity detector does not operate continusouly.

According to a further embodiment of the present invention, the control unit is arranged to initiate application of said relatively high electric voltage in the form of at least one high voltage pulse.

The high voltage may thus be realised as one single high voltage pulse with a relatively high energy or as a series of high voltage pulses. By a pulse train of for instance 100 voltage pulses during 0.1 seconds, each voltage pulse may contain significantly less energy than if only one voltage pulse is utilised. The advantage of such a pulse train is that it may start only a few ms after an animal has been detected whereas a voltage pulse with a high energy requires a relatively long time period from the moment an animal is detected until the voltage pulse is released. In addition, the subjective feeling of uncomfort for the animal touching the electric fence appears to be greater by a pulse train than by a single voltage pulse.

According to a further embodiment of the invention, the proximity detector includes an interrupting member which is arranged to interrupt the connection of at least a part of the proximity detector to said electric fence when said relatively high electric voltage is applied to said fence. In such a manner it is possible to protect the electronic components which do not stand high voltages and which may be comprised by the proximity detector.

According to a further embodiment of the invention, the proximity detector is arranged to apply a signal to said fence, wherein said parameter includes the value of a the capacitance between said fence and ground. Since the capacitance is clearly changed already at an easy contact of the electric fence, it is advantageous to detect, by any suitable method, such capacitance changes as an indication that an animal touches the fence. Already the fact that an animal is close to the electric fence, for instance 1 mm, without touching the same, however, leads to a capacitance change which is detectable. Thereby, said signal may have a determined frequency and the proximity detector may form an electric circuit in which the capacitance of said fence is included in such a manner that a change of the capacitance causes a detectable phase displacement of the signal. Such a circuit may be realised by a resistance in series with the capacitance provided by said fence. Advantageously, the resistance is formed by the inner resistance of at least one MOS-switch which may be comprised by the the interrupting member. Advantageously, the proximity detector may include a signal generator for generating said signal and a phase detector, which is arranged to sense the phase deviation between the signal generated by the signal generator and the signal applied to said fence. In order to avoid the generation of a high voltage when no animal is in the proximity of the electric fence, the phase detector may be connected to a filter member which is arranged to filter very fast undesired phase deviations. Such phase deviations may for instance be caused by disturbances from power conduits. Furthermore, a high voltage protection may be provided between the phase detector and said fence in order to protect the electronic components included by the phase detector.

According to a further embodiment of the invention, the proximity detector includes an oscillator circuit in which the capacitance between said fence and ground determines the frequency of the circuit, wherein saied parameter includes the frequency of the osciallator circuit. By such a device the oscillation frequency of the oscillator circuit will be changed when an animal touches the electric fence. Such a frequency change may in an easy manner be detected by any suitable electronics, wherein the high voltage may be applied to the electric fence.

According to a further embodiment of the invention, the electric unit is arranged to be connectable to said fence by means of one single electric connection. In such a manner the inventive device is applicable to an existing metal fence in a very easy way. Moreover, it is not necessary that the electric fence forms a closed loop but it may be opened at both ends thereof. However, the electric fence may also form a closed loop, which is usual at different types of enclosures. By the invention the advantage is thereby obtained that if this circuit is interrupted all the functions of the electric fence will still operate.

BRIEF DESCRIPTION OF THE DRAWINGS

The present invention now to be explained more closely by means of different embodiment and with reference to the drawings attached, in which FIG. 1 discloses a principal diagram of a device according to the present invention.

DETAILED DESCRIPTION OF DIFFERENT EMBODIMENTS OF THE INVENTION

Figure 1:
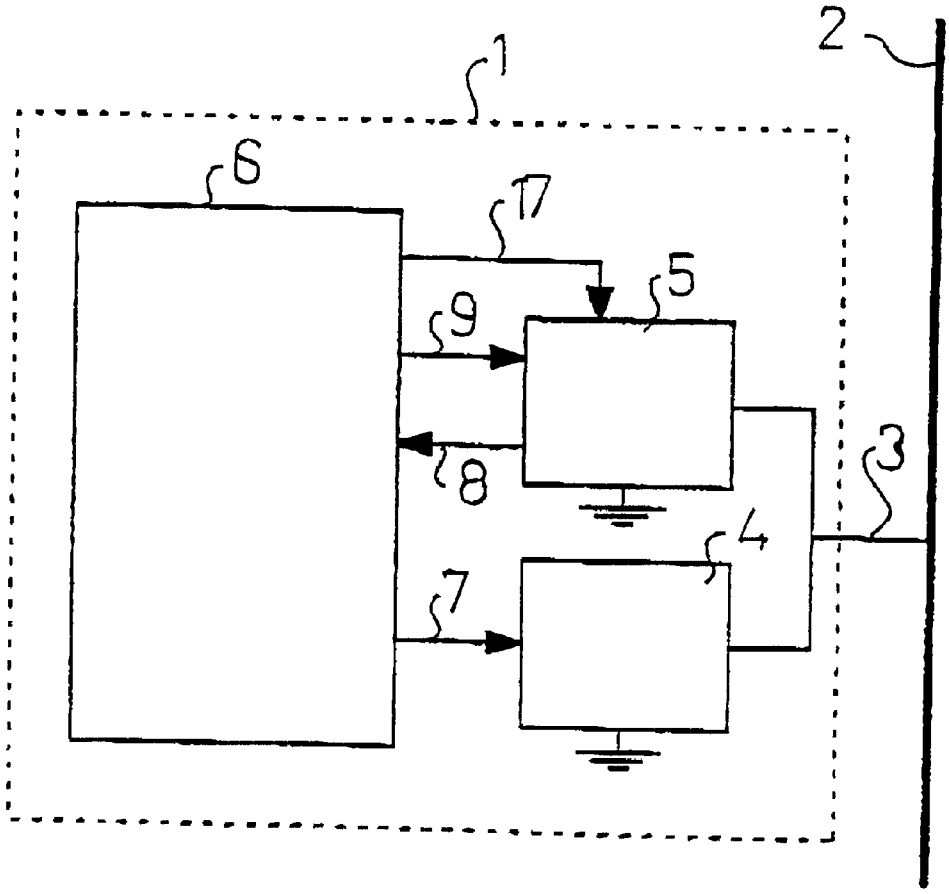

FIG. 1 discloses the basic functions included by the electric fence device according to the present invention. The device includes an electric unit 1 which is connectable to an electric fence 2 via one single electric connection in the form of an electric conduit or single conduit 3. It is to be noted that the electric conduit also may be one part of the electric fence 2 proper. The electric fence 2 may be of any conventional type and include a metal wire which is comprised of, for instance, a band or a rope. The electric fence 2 may be form an open loop, i.e. the ends of the electric fence 2 are not connected to each other or a closed loop, wherein the closed loop may be connected to the electric unit 1 via said single conduit 3.

The electric unit 1 includes a high voltage generator 4 which is arranged to generate a voltage in the order of 200–5000 V, for instance 1000 V. Moreover, the high voltage generator 4 is arranged to apply high voltage to the electric fence 2 via the conduit is Furthermore, the electric unit 1 includes a proximity detector 5, which is arranged to sense a state at which an animal is in contact with or close to the electric fence 2, and a control unit 6, which is connected to the high voltage generator 4 and the proximity detector 5, and arranged to activate the high voltage generator 4 via a connection 7 to apply high voltage to the electric fence 2 when the proximity detector 5 has detected the presence of an animal in contact with or in the proximity of the electric fence 2, and, via a connection 8, has transferred a corresponding signal to the control unit 6. Furthermore, the control unit 6 is connected to the proximity detector 5 via a connection 9 for transferring a control signal, which initiate the proximity detector 5 to perform a presence test. Such a control signal may be transferred at uniform time intervals, for instance three times per second.

Figure 2:
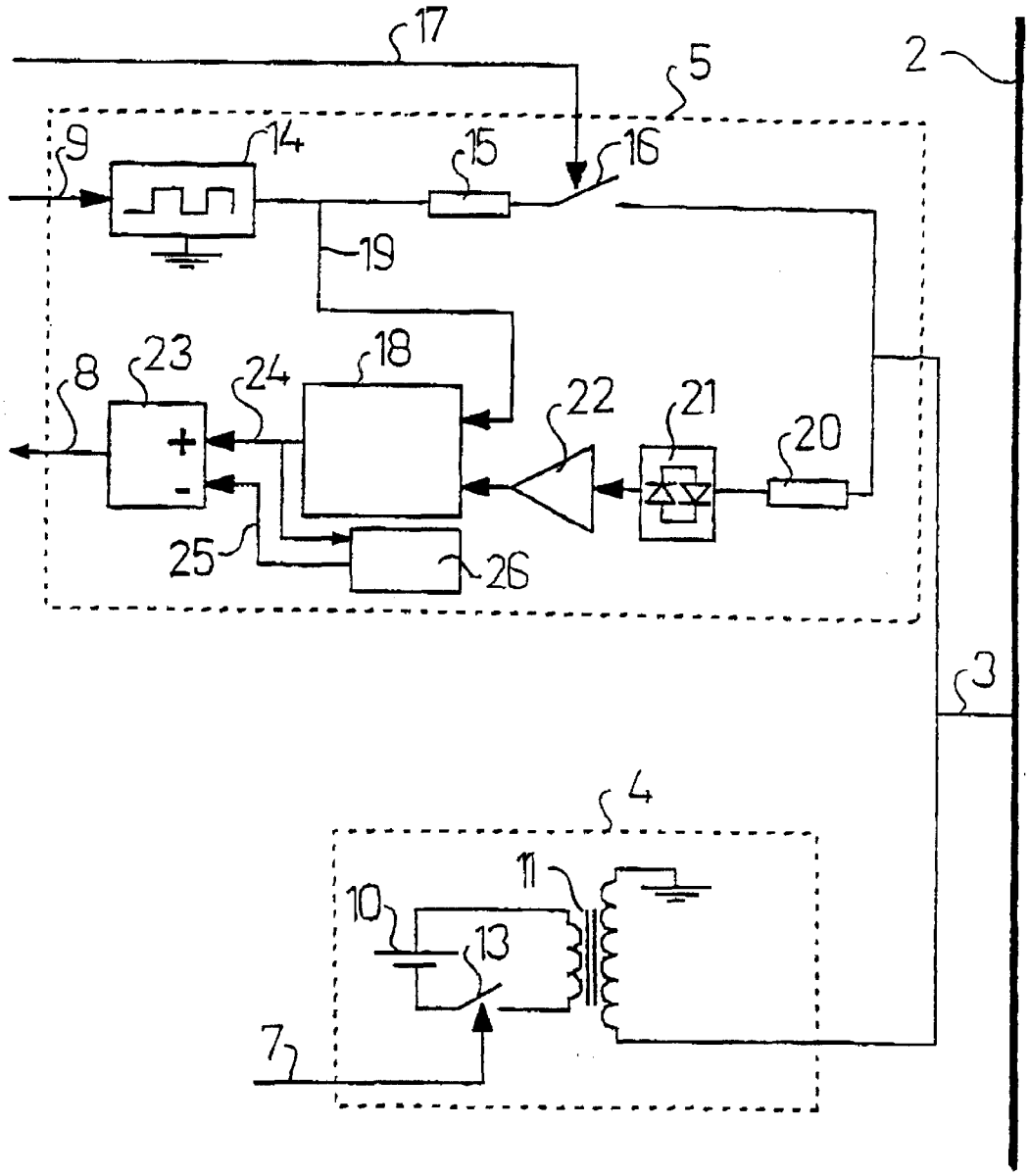
FIG. 2 discloses more closely the structure of a proximity detector and a high voltage generator of the device according to the present invention, and FIG. 3 discloses a view of the device mounted to an earth spit.

The high voltage generator 4, which is disclosed schematically in FIG. 2, is driven by a low voltage, for instance in the form of a normal 1.5 V battery 10 which is connected to the primary winding of a transformer 11. The secondary winding of the transformer 11 is connected to the ground, via an earth spit 12, see FIG. 3, and to the electric fence 2 via the conduit 3. The primary circuit of the transformer 11 includes an interrupting member 13, which is arranged to be closed by means of a control signal from the control unit 6 via the connection 7. The interrupting member 13 includes a so-called MOS-switch and is arranged to close and open the primary circuit in case of the application of a high voltage to the electric fence 2 either only once for generating a high voltage pulse or a large number of times during a time interval for generating a pulse train of high voltage pulses, for instance 100 pulses during 0.1 seconds.

It is to be noted that interrupting member 13 also may be realised in the form of a mechanical relay.

FIG. 2 also discloses a possible design of the proximity detector 5. The proximity detector 5, which also is connected to the ground via the earth spit 12, includes a signal generator 14 which when it receives the control signal mentioned above from the control unit 6 via the connection 9, is arranged to generate a signal at a certain frequency, in this embodiment for instance 50 kHz. The generated signal is conducted via a resistance 15 (1–10 kohm, preferably 3 kohm), the interrupting member 16, which normally is closed, and the conduit is to the electric fence 2.

The interrupting member 16 is arranged to receive a control signal from the control unit 6 via the connection 17. Consequently, the control unit 6 is arranged to release a control signal to the interrupting member 16 to open when high voltage is to be applied to the electric fence 2 in order to prevent high voltages from reaching susceptible electronic components of the proximity detector 5. The interrupting member 16 may be realised by one or several MOS-switches, for instance three which are provided to co-operate in such a manner that they may withstand the high voltage which is applied to the electric fence, i.e. according to this embodiment about 1000 V. The resistance 15 may in this case be the inner resistance of the MOS-switches. It is to be noted that also the interrupting member 16 may be realised in the form of a mechanical relay.

The generated signal is also transferred from the signal generator 14 to a phase detector 18 of the proximity detector 5 via the conduit 19. Since the electric fence 2 has a certain capacitance to ground, about 10 pF per meter fence, the signal at the conduit is will have another phase position than the signal at the conduit 19. The resistance 15 and the capacitance of the electric fence 2 will form a one pole low pass filter. If the capacitance of the electric fence 2 to ground is changed the phase position at the electric conduit 3 will be changed, which may be detected by means of the phase detector 18. The signal at the conduit 3 is connected to the phase detector 18 via a high ohmic resistance 20 which withstands high voltages (for instance 1 Mohm), a high voltage protection 21, which for instance may include two oppositely directed diods, and an amplifier 22 which may be limiting and which is arranged to amplify the signal from the conduit 3 so much that the phase detector 18 may detect this signal. The phase position between the conduit 19 and the output of the amplifier 22 is measured by means of the phase detector 18 and the phase position obtained is transferred as a signal to a comparator 23 via the connection 24. It is to be noted that the amplifier 22 may be an integrated part of the phase detector 18. To the comparator 23 a signal is also fed via a connection 25 which signal forms an adaptive treshold value by means of a circuit 26. The adaptive treshold value is obtained by a feed back of the signal from the connection 24, which passes a low pass filter and to which a treshold voltage is added. The circuit 25 is arranged in such a way that the treshold value slowly reaches a value which is somewhat higher than the signal of the connection 24, which permits the detection of quick capacitance changes between the electric fence 2 and ground. If the value of the signal from the phase detector 18 thus is higher than the adaptive treshold value, the comparator 23 will activate the control unit 6 by means of a signal via the connection 8. The control unit 6 may realised by means of digital technique in the form of a control circuit which is controlled by software, or in form of an electronic digital circuit which does not contain any software.

Also the proximity detector 5 and the control 6 are driven by a low voltage from, for instance a 1.5 V battery which via a converter may give an appropriate drive voltage. Advantageously, the same battery 10 as to the high voltage generator 4 may be utilised also for these units, wherein one of the poles of the battery 10 may be connected to ground.

The proximity detector 5 which is schematically disclosed in FIG. 1, may be designed in many different ways. According to the invention, it is to be arranged to sense the capacitance changes which arises between the electric fence 2 and ground when an animal approaches the electric fence 2. For instance, the proximity detector 5 may include an osciallator circuit, in which the capacitance between the electric fence and ground are included as a component which at least partly determines the frequency of the oscillator circuit. Thereby, the proximity detector 5 includes also a frequency sensor which may detect changes in the frequency of the osciallator circuit and in such a way detect the capacitance changes between the electric fence 2 and ground, i.e. if an animal is in the proximity of or in contact with the electric fence 2. Also in this case, the proximity detector may include an interrupting member 16 which prevents high voltage from reaching electronic components of the proximity detector 5. Also in this case, the detection may be performed discontinuously, for instance three times per second during short time periods.

Figure 3:
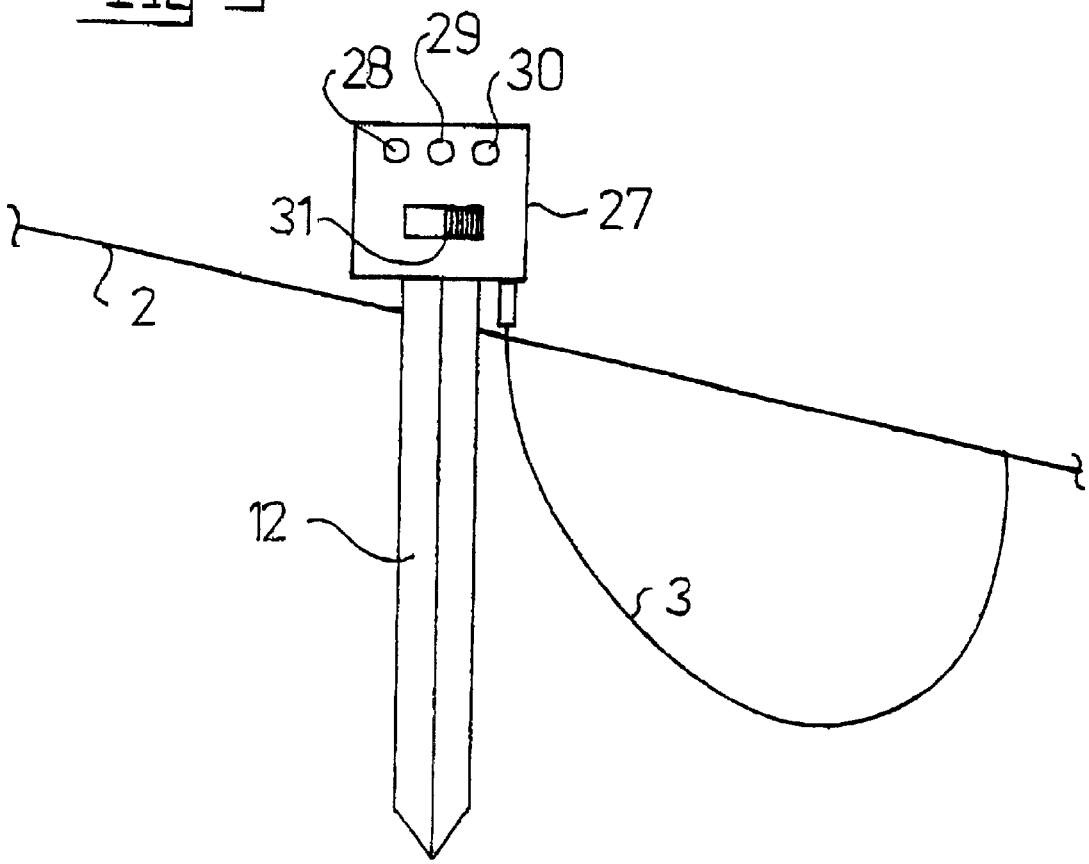

FIG. 3 discloses the inventive device mounted to an earth spit 12. The device, i.e. the electric unit 1 is housed in a casing 27 which has relatively small dimensions and which houses all electronics and the current supply. The device according to the invention requires as little energy that a normal 1.5 V is sufficient for a long time operation of the device. Furthermore, the device includes indicating members in the form of three light diods 28, 29, 30 of different colours. The light diod 28 is arranged to give a light when a chock is released, the light diod 29 is arranged to give a light when the presence of an animal is detected, at the same time as the high voltage is shut off, and the light diod 30 is arranged to indicate the battery function. Furthermore, the device includes a switch member 31 for activating the high voltage function. FIG. 3 also discloses the electric conduit is which connects the device to the electric fence 2. When the device is mounted the earth spit 12 is in the first place driven down into the ground at an appropriate distance from the electric fence 2 and thereafter the device housed in the casing 27 is mounted to the earth spit 12.

The present invention is not limited to the embodiment disclosed above but may be varied and modified within the scope of the following claims.

It is to be noted that one of several of the components 18, 23 and 26 also are realisable in the form of software in a micro processor or any other digital control circuit.

What is claimed is:

1. A device for an electric fence, including an electric unit, which is connectable to an electrically conducting fence and includes a voltage generator arranged to apply a relatively high electric voltage to said fence, a proximity detector, which is arranged to sense a state at which an animal is in contact with or in the proximity of said fence, and a control unit, which is connected to the voltage generator and the proximity detector and arranged to activate the voltage generator to apply said relatively high electric voltage to said fence in response to said state, wherein the control unit is arranged to initiate said sensing discontinuously during relatively short recurrent time periods, characterized in that the proximity detector is arranged to detect said state by sensing an electric parameter substantially dependent on the capacitance between said fence and ground, wherein:

the proximity detector includes a signal generator generating a signal of a determined frequency;

the proximity detector forms a circuit, including the capacitance of said fence to ground and a resistance in series with the capacitance;

proximity detector is arranged to conduct said signal from the signal generator via the resistance and a conduit to the fence; and the proximity sensor includes a phase detector arranged to detect said state by comparing the phase position of the signal generated by the signal generator and the signal at the conduit.

2. A device according to claim 1, characterized in that the control unit is arranged to initiate application of said relatively high electric voltage in the form of at least one high voltage pulse.

3. A device according to claim 1, characterized in that the proximity detector includes an interrupting member which is arranged to interrupt the connection of at least a part of the proximity detector to said electric fence when said relatively high electric voltage is applied to said fence.

4. A device according to claim 3, characterized in that the interrupting member includes at least one MOS-switch and that said resistance forms the inner resistance of said MOS-switch.

5. A device according to claim 1, characterized in that said parameter includes the value of the capacitance between said fence and ground.

6. A device according to claim 1, characterized in that the phase detector is connected to a filter member which is arranged to filter away very fast undesired phase deviations caused by disturbances.

7. A device according to claim 1, characterized in that a high voltage protection is provided between the phase detector and said fence.

8. A device according to claim 1, characterized in that the electric unit is housed in a casing which is mountable to an earth apit.

9. A device according to claim 1, characterized in that the electric unit is arranged to be connectable to said fence by means of one single electric connection.

* * * * *